United States Patent [19]

Lemmon

[11] 4,396,121

[45] Aug. 2, 1983

[54] JEWELRY DISPLAY BOX

[76] Inventor: Mildred K. Lemmon, P.O. Box 681, Globe, Ariz. 85501

[21] Appl. No.: 302,632

[22] Filed: Sep. 15, 1981

[51] Int. Cl.[3] ..... B65D 1/24; B65D 85/00

[52] U.S. Cl. ..... 206/566; 206/45.34; 206/44 R; 220/22

[58] Field of Search ..... 206/45.34, 566, 461, 206/526, 499, 205, 0.83, 45.28, 44 R; 220/20, 22

[56] References Cited

U.S. PATENT DOCUMENTS 2,559,289 7/1951 Eisen et al. ..... 206/566
2,714,443 8/1955 Kuvin ..... 206/205
3,406,821 10/1968 Weissberg ..... 206/526
3,606,007 9/1971 Huston, Jr. ..... 206/461

FOREIGN PATENT DOCUMENTS 411236 6/1937 United Kingdom ..... 206/45.28

*Primary Examiner*—William T. Dixson, Jr.
*Attorney, Agent, or Firm*—Harry M. Weiss

[57] ABSTRACT

A jewelry display box which incorporates a completely transparent structure, a removable top, and sliding mounting plates to serve as a device to visibly, effectively, and efficiently store and inspect a collection of jewelry.

5 Claims, 4 Drawing Figures

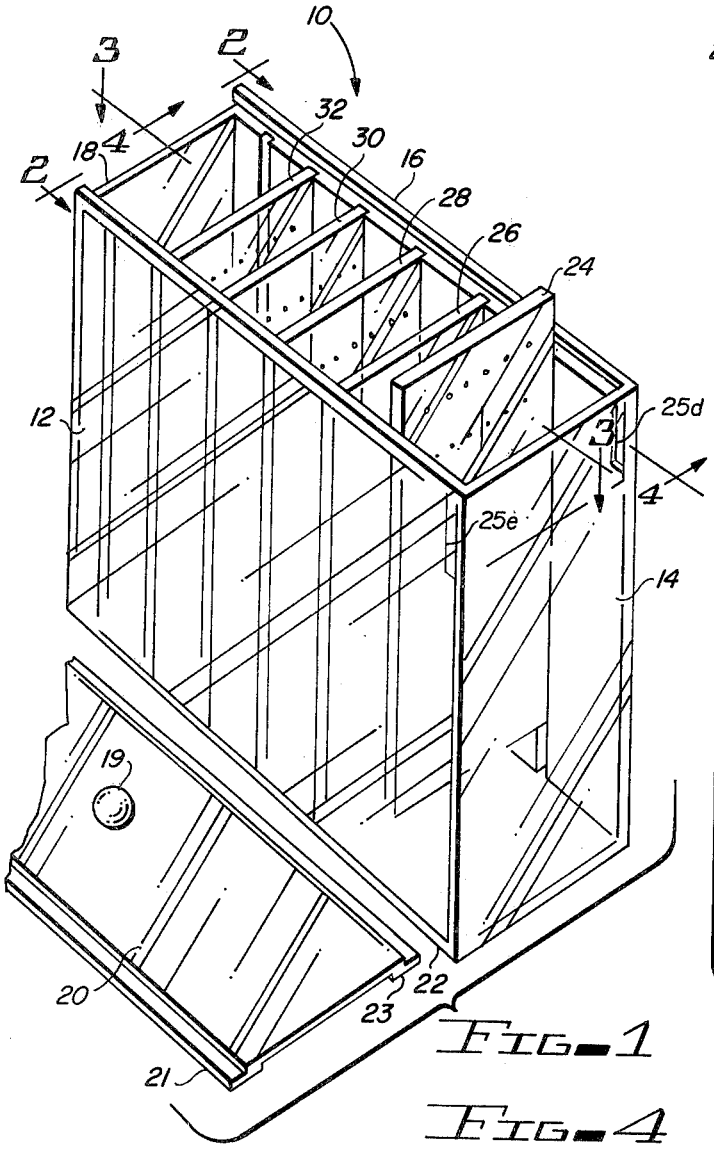
FIG-1
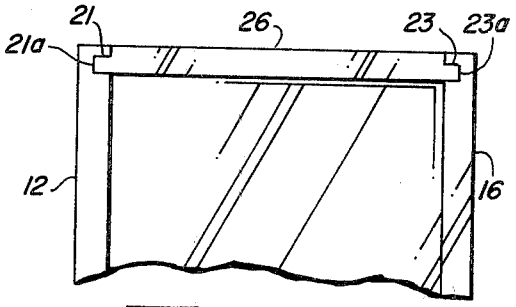
FIG-2
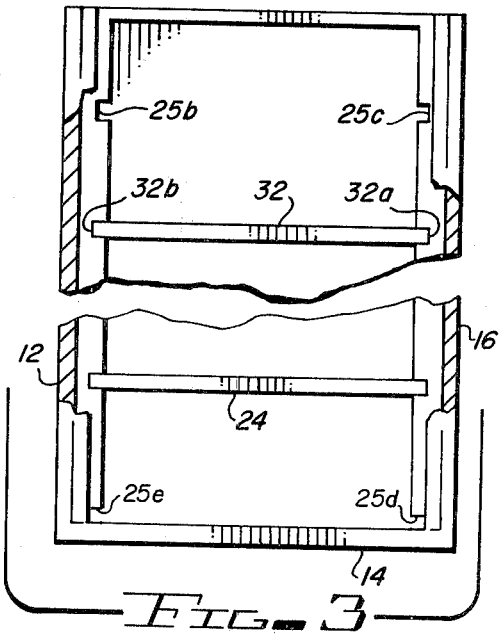
FIG-3
FIG-4
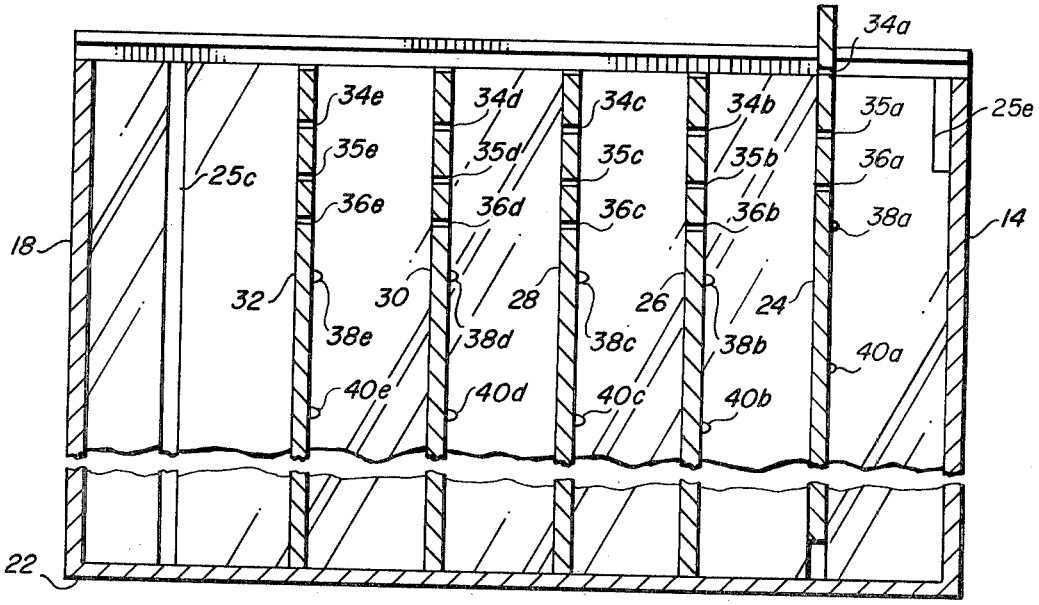

JEWELRY DISPLAY BOX

BACKGROUND OF THE INVENTION

1. Field of the Invention

This invention relates generally to a case for storing and displaying jewelry, and, more specifically, to a case that can retain large amounts of jewelry in an easily accessible and visible manner.

2. Description of the Prior Art

In the past, a number of products have been disclosed with the intention of effectively storing or displaying jewelry. In one type of prior art product, a jewelry box was fabricated in a configuration resembling a miniature piece of furniture, such as a china closet, chest, dresser, etc. While this type of jewelry box was aesthetically pleasing, the small storage containers within it were insufficient to separately store an individual's large quantity of jewelry. The result was often a tangled conglomeration of chains and earrings. In addition, there was not included a way to visibly display the jewelry.

In another type of prior art product, jewelry display frames took the shape of many popular items, such as television characters, animals, mushrooms, trees, etc. According to this embodiment, the jewelry was attached to hooks on or inserted through holes in the figures. While the jewelry was visibly displayed, only small quantities of jewelry could be attached to the limited peripheral area of any figure. In addition, these figures were relatively unstable and did not protect the jewelry because the figures would easily tip over, often causing damage to many pieces of jewelry.

The need existed to provide an improved jewelry display box capable of combining the abilities to effectively store, display, protect, and provide easy access to a large amount of jewelry.

SUMMARY OF THE INVENTION

According to one embodiment of this invention, it is an object of this invention to provide an improved jewelry display box.

It is another object of this invention to provide a jewelry display box capable of individually storing large quantities of jewelry, such as earrings, chains, and pins.

It is yet another object of this invention to provide a jewelry display box that is transparent so as to allow for all the jewelry stored in the box to be visible.

It is a final object of this invention to provide a jewelry display box that is simplistic, thereby facilitating use by children.

Briefly described, and in accordance with one embodiment of this invention, an improved transparent jewelry display box is disclosed comprising at least one transparent mounting board for storing jewelry to be displayed and mounted so as to slide vertically within an internal track which is disposed to receive the mounting board's full length. A plurality of mounting boards can be used, if desired, each sliding into the vertical tracks of the display box. Jewelry is retained on the mounting board via a plurality of holes, loops, or hooks through which earrings or chains can be inserted or hooked thereto. The jewelry display box, containing the plurality of sliding mounting boards, is then covered with a transparent top which, in a manner similar to the mounting boards, slides onto the top of the box. In this configuration, the sliding mounting boards are held in place and the jewelry protected.

The foregoing and other objects, features, and advantages will be apparent from the following, more particular, description of the preferred embodiments of the invention, as illustrated in the accompanying drawings.

BRIEF DESCRIPTION OF THE DRAWING

FIG. 1 is a perspective view of the jewelry display box.

FIG. 2 is a cut-away view of the jewelry display box of FIG. 1 taken along the line 2—2 of FIG. 1.

FIG. 3 is a cut-away view of the jewelry display box of FIG. 1 taken along the line 3—3 of FIG. 1.

FIG. 4 is a top view of sections of the jewelry display box of FIG. 1 taken along the line 4—4 of FIG. 1.

THE SPECIFICATION

Referring to FIG. 1, the jewelry display box is referenced generally by the number 10. The frame of the box is comprised of vertical side wall panels 12 and 16, vertical front and back panels 14 and 18 respectively, bottom floor panel 22, and sliding top panel 20. Connected to the top panel 20 to serve as a device to grasp by a person's hand is a knob 19, or some other suitable means of firmly holding the removable top panel. Also configured in a removable manner are the mounting plates 24 (partially removed), 26, 28, 30, and 32.

Referring to FIG. 2, the top plate 20 is fabricated so as to contain rails 21 and 23 at its outer edges. The rails 21 and 23 slide into tracks 21*a* and 23*a* located in the side wall panels 12 and 16, respectively. In this manner, the top panel 20 can be slid back or off of the top of jewelry display box 10, allowing access to or removal of the mounting plates.

Referring to FIG. 3, the removable mounting plate 32 slides into rails 32*b* and 32*c*. Rails 25*b* and 25*c* are shown empty to illustrate the removable quality of the mounting plates.

Referring to FIG. 4, the mounting plates 24 through 32 are shown. Holes 34*a* through *e*, 35*a* through *e*, and 36*a* through *e* are used to hold earrings of the kind having a shaft and clasp. Loops 38*a* through *e*, and 40*a* through *e* can be used to hold loop earrings or assorted pins.

To load or store earrings, for example, the top is first removed, then the mounting plate is slid out of the jewelry box and inserted into notches 25*d* and 25*e*, where the mounting plate is securely held by the box. As a result, both hands of the user are free to store or remove the stored item. For example, a post earring is then inserted through one of the holes and clasped on the other side. The mounting plate is returned to its position back inside the display box and the top is slid back into place. In this manner, one can easily, visibly, and effectively store jewelry.

In a second embodiment (not shown) of this jewelry display box, instead of fabricating all mounting panels with holes and loops, a portion of them can be fabricated with other types of holding instruments. In this manner, different types of jewelry can be stored. For example, by incorporating the use of hooks, chains can easily be stored.

Whereas the invention has been particularly shown and described with reference to preferred embodiments thereof, it will be understood by those skilled in the art that the foregoing and other changes in form and details may be made therein without departing from the spirit and scope of the invention.

What is claimed is:

1. A jewelry display case comprising:

a plurality of removable mounting jewelry display board means for holding and displaying jewelry items to be displayed, each of said display board means being made of transparent material and having a plurality of apertures for holding said jewelry items; and a box member having at least a plurality of internal tracks with each one of said plurality of tracks being disposed to receive the full length of one of said display board means, said box member being made of transparent material.

2. A jewelry display case in accordance with claim 1 wherein said box member further having a notch disposed to receive an end portion of one of said plurality of display board means so that the jewelry items of said one of said plurality of display board means is displayed in an elevated position above said box member.

3. A jewelry display case in accordance with claim 2 wherein said notch having a location at an end of said box member.

4. A jewelry display case in accordance with claim 3 wherein said notch and each of said tracks having a common parallel plane.

5. A jewelry display case in accordance with claim 4 further comprising:

a cover of transparent material slidably engaged in said box so that the exposed end of each of said board means engaged in one of said tracks can be selectively covered.

* * * * *